US011685038B2

(12) United States Patent
Lai

(10) Patent No.: US 11,685,038 B2
(45) Date of Patent: Jun. 27, 2023

(54) TOOL BOX

(71) Applicant: KING TONY TOOLS CO., LTD., Taichung (TW)

(72) Inventor: Ching-Hua Lai, Taichung (TW)

(73) Assignee: KING TONY TOOLS CO., LTD., Taichung (TW)

( * ) Notice: Subject to any disclaimer, the term of this patent is extended or adjusted under 35 U.S.C. 154(b) by 20 days.

(21) Appl. No.: 17/542,357

(22) Filed: Dec. 3, 2021

(65) Prior Publication Data

US 2022/0176541 A1 Jun. 9, 2022

(30) Foreign Application Priority Data

Dec. 8, 2020 (TW) ..... 109143229

(51) Int. Cl.
*B25H 3/00* (2006.01)
*B25H 3/02* (2006.01)

(52) U.S. Cl.
CPC ..... *B25H 3/003* (2013.01); *B25H 3/02* (2013.01)

(58) Field of Classification Search
CPC ..... B25H 3/003; B25H 3/023; B25H 3/02; B25H 3/028; B25H 3/021; B25H 3/06; B25H 3/00; B25H 3/04
USPC ..... 211/70.6; 206/373, 372, 349, 379, 377, 206/378, 234
See application file for complete search history.

(56) References Cited

U.S. PATENT DOCUMENTS 4,305,629 A * 12/1981 Friis ..... A47B 88/988 248/37.3
5,368,164 A * 11/1994 Bennett ..... B25H 3/06 206/379
5,839,579 A * 11/1998 Lee ..... B25H 3/06 206/378
5,915,554 A * 6/1999 Hung ..... B65D 51/002 206/372
6,415,924 B1 * 7/2002 Lee ..... B25H 3/023 206/459.5
7,325,682 B2 * 2/2008 Seymour ..... B25H 3/003 206/754
7,931,143 B1 * 4/2011 Lin ..... B25H 3/021 220/629
10,710,235 B1 * 7/2020 Cantlon ..... B25H 3/025
2002/0162842 A1 * 11/2002 Pangerc ..... B65D 77/0446 220/524
2003/0015447 A1 * 1/2003 Huang ..... B25H 3/023 211/70.6
2004/0069668 A1 * 4/2004 Finnigan ..... B25H 3/003 206/378
2004/0200749 A1 * 10/2004 Wang ..... B25H 3/003 206/349

(Continued)

*Primary Examiner* — Steven A. Reynolds
*Assistant Examiner* — Prince Pal
(74) *Attorney, Agent, or Firm* — Pai Patent & Trademark Law Firm; Chao-Chang David Pai

(57) ABSTRACT

A tool box includes a first housing and a second housing that can be opened and closed relative to the first housing. A first receiving seat and a second receiving seat are rotatably connected in the second housing for receiving a plurality of screwdriver bits. When the tool box is closed, the first receiving seat and the second receiving seat are turned in opposite directions to be accommodated in the second housing, and the bits received in the first receiving seat and the bits received in the second receiving seat are partially overlapped.

9 Claims, 15 Drawing Sheets

(56) References Cited

U.S. PATENT DOCUMENTS

2004/0207298 A1* 10/2004 Rodon ..... B25H 3/023 312/246
2004/0256265 A1* 12/2004 Pangerc ..... B25H 3/003 206/349
2005/0161356 A1* 7/2005 Chen ..... B25H 3/003 206/378
2005/0241973 A1* 11/2005 Adkins ..... B25H 3/023 206/349
2006/0108246 A1* 5/2006 Chen ..... B25H 3/00 206/379
2006/0201835 A1* 9/2006 Shih ..... B25H 3/023 206/373
2007/0272572 A1* 11/2007 Chen ..... B25H 3/021 206/373
2009/0145786 A1* 6/2009 Panosian ..... B25H 3/003 206/234
2012/0090215 A1* 4/2012 Buie, II ..... B25H 3/023 42/95
2013/0284773 A1* 10/2013 Meng ..... B25H 3/003 206/349
2014/0023475 A1* 1/2014 Meyers ..... B25J 1/00 414/800
2016/0008973 A1* 1/2016 Bensman ..... B65D 43/16 206/372
2016/0053987 A1* 2/2016 Hsu ..... B25H 3/02 206/372
2016/0290013 A1* 10/2016 Lin ..... B25H 3/003
2016/0346915 A1* 12/2016 Lin ..... B25H 3/02
2017/0361454 A1* 12/2017 Hsu ..... B25H 3/003
2019/0168376 A1* 6/2019 Brocket ..... B25H 3/02
2020/0324399 A1* 10/2020 Christen ..... B25H 3/022
2021/0078159 A1* 3/2021 Jiang ..... B65D 21/0213
2021/0245358 A1* 8/2021 Hohl ..... B25H 3/06
2021/0394354 A1* 12/2021 Miley ..... B25H 3/04
2022/0226981 A1* 7/2022 Adams ..... B65D 21/0204
2022/0297283 A1* 9/2022 Chen ..... B25H 3/02
2023/0036215 A1* 2/2023 Williams ..... B25H 3/021

* cited by examiner

TOOL BOX

FIELD OF THE INVENTION

The present invention relates to a tool box, and more particularly to a tool box for storing a tool bit set.

BACKGROUND OF THE INVENTION

A conventional tool box mainly has a box body. The box body is provided with a plurality of receiving seats arranged side by side for receiving a plurality of bits. The receiving seats are connected with each other through a linking structure such as gears or connecting rods. Besides, the box body is provided with a cover connected with the linking structure. When the user opens the cover, the cover drives the receiving seats to extend out of the box body for the user to take a desired bit out. When the user closes the cover, the cover drives the receiving seats to retract into the box body.

However, the receiving seats are rotated in the same direction. Such a design leads to shorter distance from the axis of rotation between the receiving seats. When the receiving seats extend out of the box body, due to restricted distance between the receiving seats, a user is inconvenient to distinguish and take the desired bit out. On the other hand, when the receiving seats are retracted into the box body, the receiving seats occupy a larger area due to common symmetrical design. It is not beneficial to miniaturize the tool box. In addition, driving the receiving seats of the tool box by gears or connecting rods affects the opening angle of the cover and the convenience for the user to take the desired bit. When the conventional tool box is dropped or impacted by an external force, it is easy to cause damage.

SUMMARY OF THE INVENTION

The primary object of the present invention is to provide a tool box that is compact as a whole, without affecting the convenience for a user to take the bits and achieve the effect of miniaturizing the tool box.

In order to achieve the above object, the present invention provides a tool box, comprising a first housing, a second housing connected to the first housing through a hinge member, a first receiving seat, and a second receiving seat. The second housing is rotatable relative to the first housing with the hinge member as its axis of rotation to be in a closed position or an open position. The first housing has a first guide portion and a second guide portion. The second housing has a second accommodating space therein. The first receiving seat is rotatably connected in the second accommodating space through a first connecting portion. The first receiving seat is provided with a plurality of spaced first receiving grooves. The second receiving seat is rotatably connected in the second accommodating space of the second housing through a second connecting portion. The second receiving seat is provided with a plurality of spaced second receiving grooves. When the second housing is in the open position, the first receiving seat is pushed by a first elastic member to rotate in a first direction so that the first receiving seat is turned out of the second accommodating space, and the second receiving seat is pushed by a second elastic member to rotate in a second direction opposite to the first direction so that the second receiving seat is turned out of the second accommodating space. When the second housing is in the closed position, the first receiving seat is guided by the first guide portion to rotate in the second direction to be accommodated in the second accommodating space, and the second receiving seat is guided by the second guide portion to rotate in the first direction to be accommodated in the second accommodating space, and a central axis of the second receiving grooves and a central axis of the first receiving grooves are located on different planes.

With the tool box provided by the present invention, the user can put a plurality of bits in the first receiving grooves and the second receiving grooves, respectively. When the second housing is in the open position, the first receiving seat and the second receiving seat are turned out of the second accommodating space in opposite directions, so that the distance between the first receiving seat and the second receiving seat can be increased for the user to take the bits. When the second housing is in the closed position, the first receiving seat and the second receiving seat are turned in opposite directions to be accommodated in the second accommodating space, and the central axis of the second receiving grooves and the central axis of the first receiving grooves are located on different planes. Thereby, the bits received in the first receiving seat and the bits received in the second receiving seat are partially overlapped, so that the area of the second accommodating space occupied by the first receiving seat and the second receiving seat can be effectively reduced. The tool box is relatively compact as a whole and achieves the purpose of miniaturizing the tool box.

DETAILED DESCRIPTION OF THE PREFERRED EMBODIMENTS

Embodiments of the present invention will now be described, by way of example only, with reference to the accompanying drawings.

Figure 1:
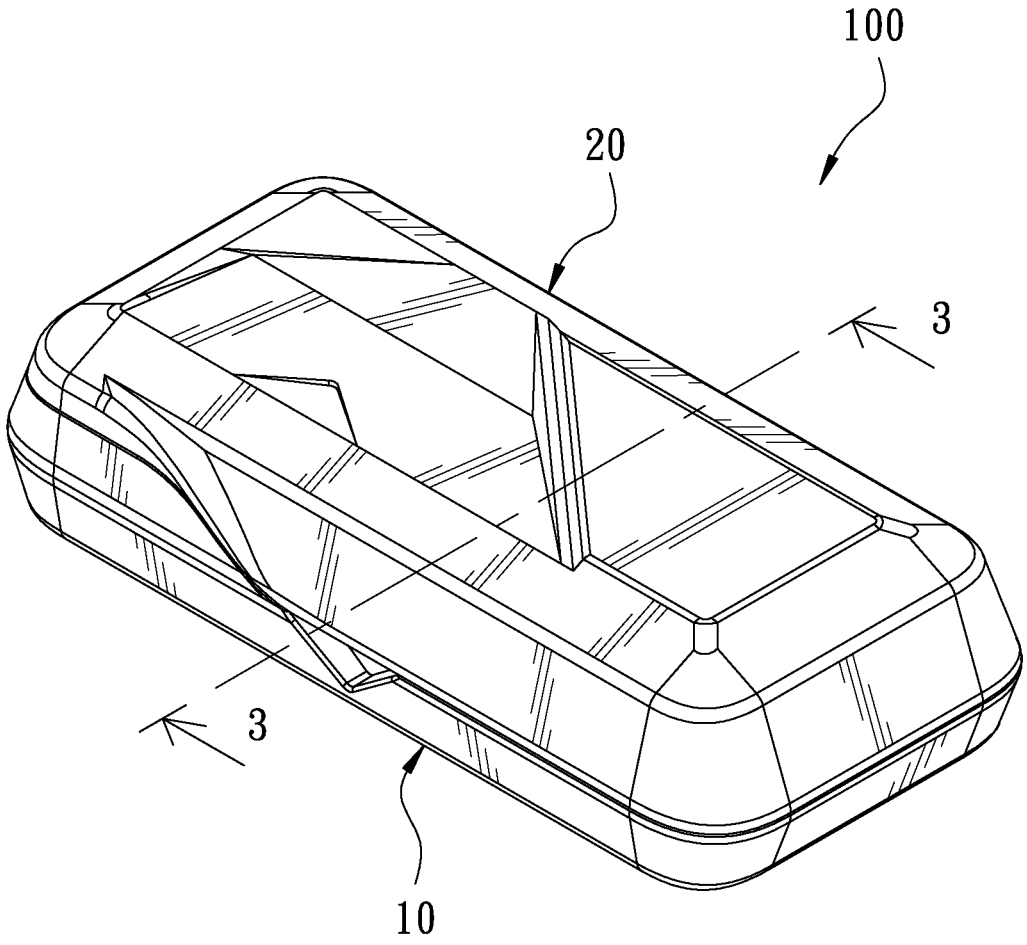
FIG. 1 is a perspective view of a preferred embodiment of the present invention in a closed state.
Figure 2:
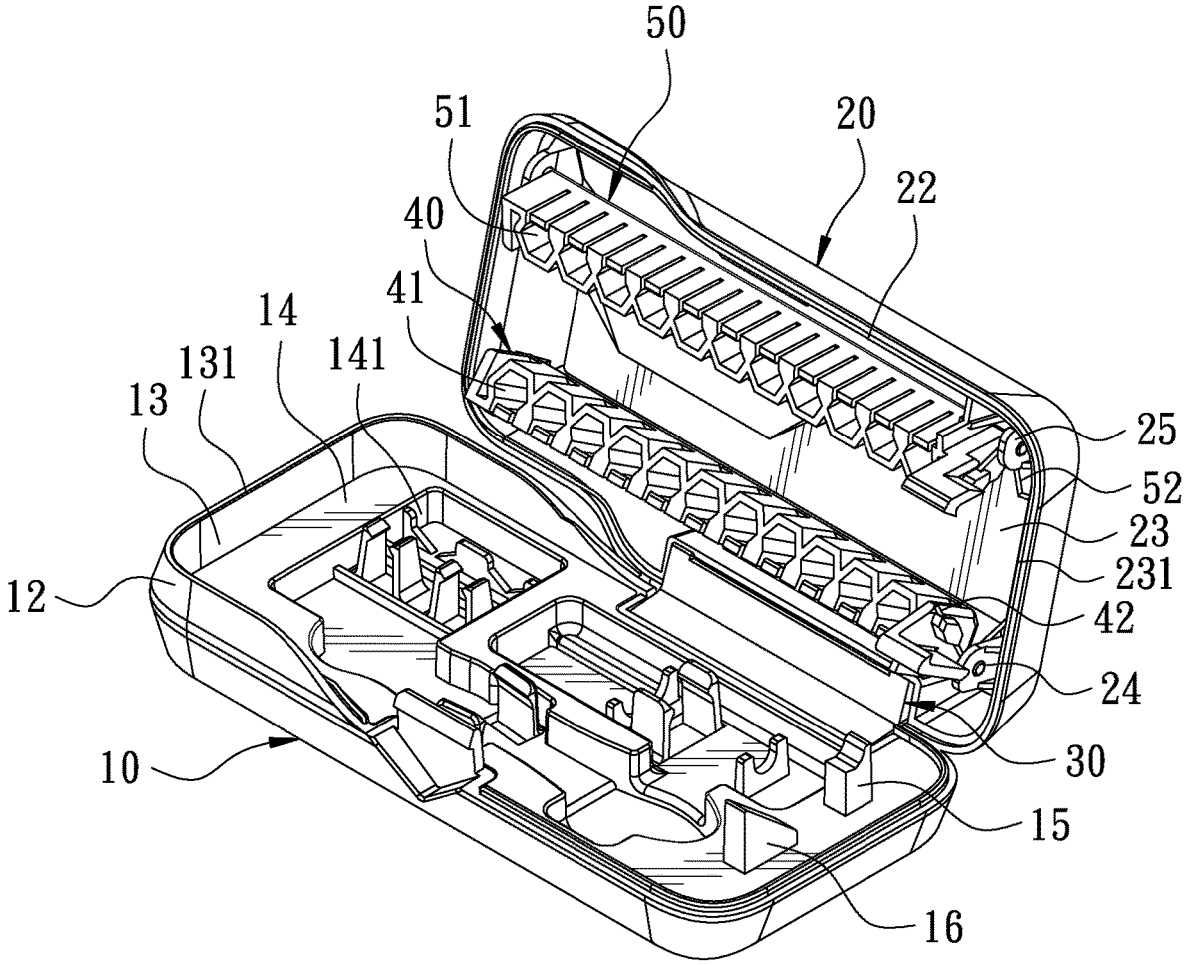
FIG. 2 is a perspective view of the preferred embodiment of the present invention in an open state.
Figure 3:
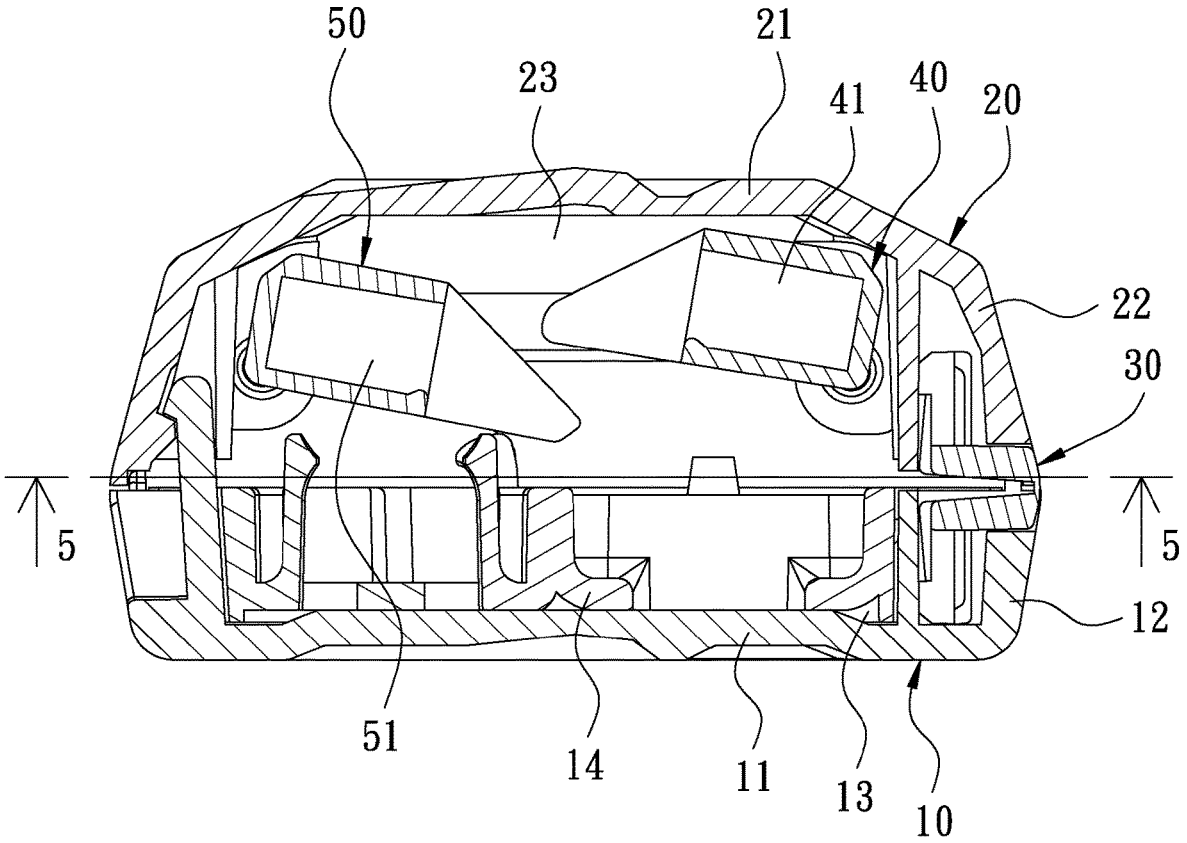
FIG. 3 is a cross-sectional view taken along line 3-3 of FIG. 1.

FIG. 1 is a perspective view of a preferred embodiment of the present invention in a close state. FIG. 2 is a perspective view of the preferred embodiment of the present invention in an open state. FIG. 3 is a cross-sectional view taken along line 3-3 of FIG. 1. The present invention discloses a tool box 100, comprising a first housing 10, a second housing 20, a first receiving seat 40, and a second receiving seat 50.

The first housing 10 has a first bottom wall 11, a first circumferential wall 12 connected to the first bottom wall 11, and a first accommodating space 13 defined between the first bottom wall 11 and the first circumferential wall 12. The first accommodating space 13 has a first opening 131. The first housing 10 further has a storage tray 14 in the first accommodating space 13. The storage tray 14 has a plurality of accommodating grooves 141.

The second housing 20 is connected to the first housing 10. The second housing 20 has a second bottom wall 21, a second circumferential wall 22 connected to the second bottom wall 21, and a second accommodating space 23 defined between the second bottom wall 21 and the second circumferential wall 22. The second accommodating space 23 has a second opening 231. At least one portion of the second circumferential wall 22 is hingedly connected to the first circumferential wall 12 through a hinge member 30, so that the second housing 20 is rotatable relative to the first housing 10 with the hinge member 30 as its axis of rotation to be in a closed position as shown in FIG. 1 or an open position as shown in FIG. 2. In the open position, the second housing 20 is moved away from the first housing 10. In the closed position, the second housing 20 covers the first opening 131 of the first housing 10. The second opening 231 faces the first opening 131. In addition, the second housing 20 further includes a first connecting portion 24 and a second connecting portion 25 in the second accommodating space 23.

The first receiving seat 40 is accommodated in the second accommodating space 23 and is rotatably connected to the first connecting portion 24. The first receiving seat 40 is provided with a plurality of spaced first receiving grooves 41. The first receiving seat 40 is connected with at least one first elastic member 42. When the second housing 20 is moved toward the open position, the first elastic member 42 pushes the first receiving seat 40 to extend out of the second opening 231 and makes the first receiving grooves 41 face toward the exterior of the second opening 231.

The second receiving seat 50 is accommodated in the second accommodating space 23 and is rotatably connected to the second connecting portion 25. The second receiving seat 50 is provided with a plurality of spaced second receiving grooves 51. The second receiving seat 50 is connected with at least one second elastic member 52. When the second housing 20 is moved toward the open position, the second elastic member 52 pushes the second receiving seat 50 to extend out of the second opening 231 and makes the second receiving grooves 51 face toward the exterior of the second opening 231.

Figure 4:
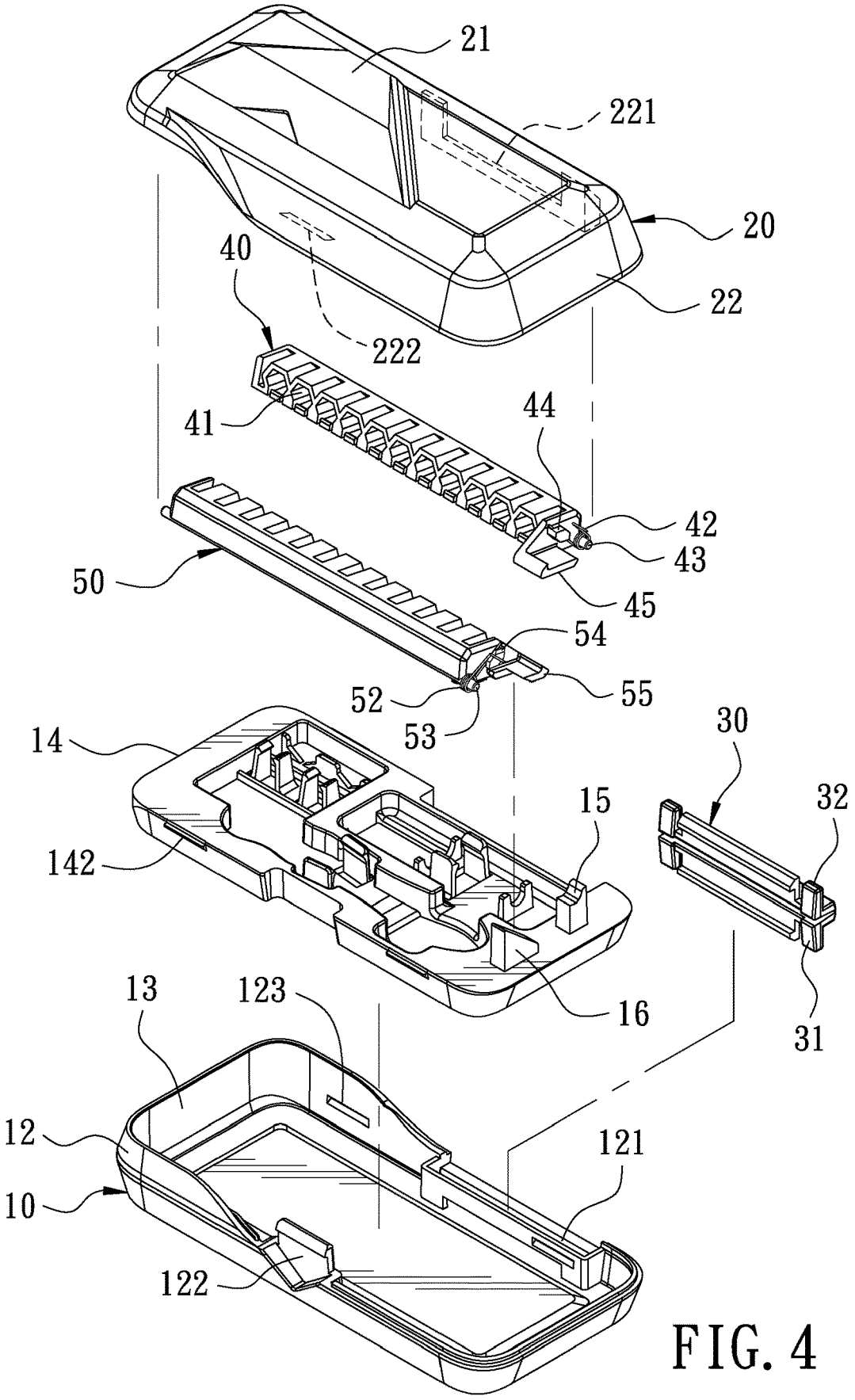
FIG. 4 is an exploded view of the preferred embodiment of the present invention.
Figure 5:
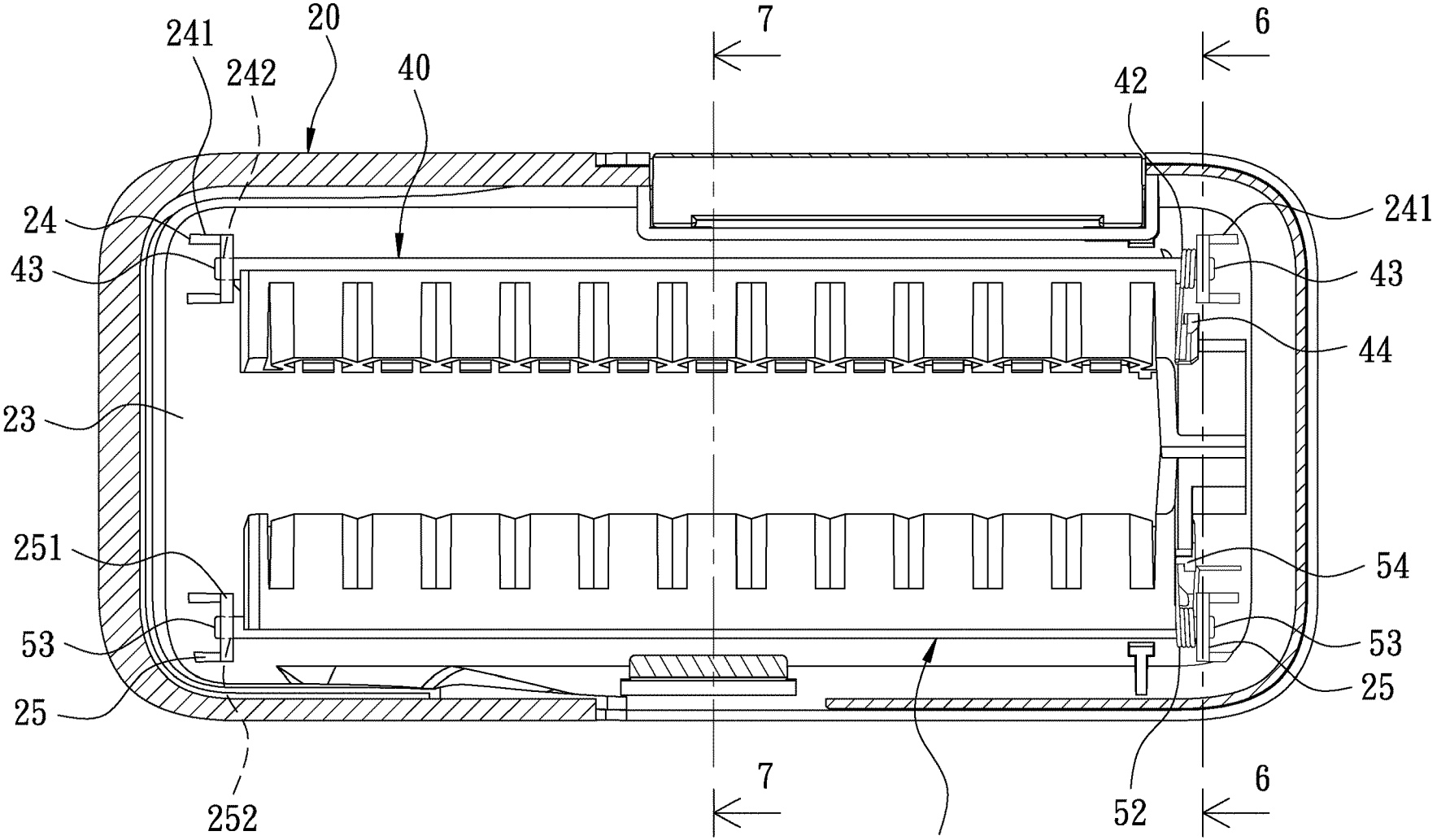
FIG. 5 is a cross-sectional view taken along line 5-5 of FIG. 3.

FIG. 4 is an exploded view of the preferred embodiment of the present invention. FIG. 5 is a cross-sectional view taken along line 5-5 of FIG. 3. The first circumferential wall 12 of the first housing 10 is formed with a first connecting groove 121. The second circumferential wall 22 of the second housing 20 is formed with a second connecting groove 221 corresponding to the first connecting groove 121. The hinge member 30 has a first connecting portion 31 and a second connecting portion 32 that are hinged to each other. The first connecting portion 31 is connected to the first connecting groove 121. The second connecting portion 32 is connected to the second connecting groove 221. Thus, the second housing 20 is rotatable relative to the first housing 10 with the hinge member 30 as its axis of rotation. In addition, the first circumferential wall 12 of the first housing 10 is provided with a buckling portion 122. The second circumferential wall 22 of the second housing 20 is formed with a buckling groove 222. When the second housing 20 is in the closed state, the buckling portion 122 is buckled to the buckling groove 222 to secure the second housing 20 to cover the first housing 10. An inner surface of the first circumferential wall 12 of the first housing 10 is formed with a plurality of first coupling grooves 123, and the periphery of the storage tray 14 is provided with a plurality of coupling portions 142 corresponding to the coupling grooves 123, so that the storage tray 14 is detachably connected to the first housing 10 and received in the first accommodating space 13. As shown in FIG. 4 and FIG. 5, the first connecting portion 24 is in the form of a pair of first lugs 241. Each of the first lugs 241 has a first through hole 242. Two sides of the first receiving seat 40 have first rotating shafts 43 corresponding to each of the first lugs 241, respectively. Each of the first rotating shafts 43 is rotatably connected to each of the first through holes 242 respectively, so that the first receiving seat 40 is rotatable relative to the second housing 20. The first receiving seat 40 has a first positioning portion 44 corresponding to at least one of the first rotating shafts 43. The first elastic member 42 is a torsion spring fitted on the corresponding first rotating shaft 43. The first elastic member 42 has two elastic arms abutting against the first positioning portion 44 and an inner surface of the second bottom wall 21, respectively. Thus, the first receiving seat 40 enables to be rotated toward the exterior of the second opening 231. Similarly, the second connecting portion 25 is in the form of a pair of second lugs 251. Each of the second lugs 251 has a second through hole 252. Two sides of the second receiving seat 50 have second rotating shafts 53 corresponding to each of the second lugs 251, respectively. Each of the second rotating shafts 53 is rotatably connected to each of the second through holes 252 respectively, so that the second receiving seat 50 is rotatable relative to the second housing 20. The second receiving seat 50 has a second positioning portion 54 corresponding to at least one of the second rotating shafts 53. The second elastic member 52 is a torsion spring fitted on the corresponding second rotating shaft 53. The second elastic member 52 has two elastic arms abutting against the second positioning portion 54 and the inner surface of the second bottom wall 21, respectively. Thus, the second receiving seat 50 enables to be rotated toward the exterior of the second opening 231.

Figure 6:
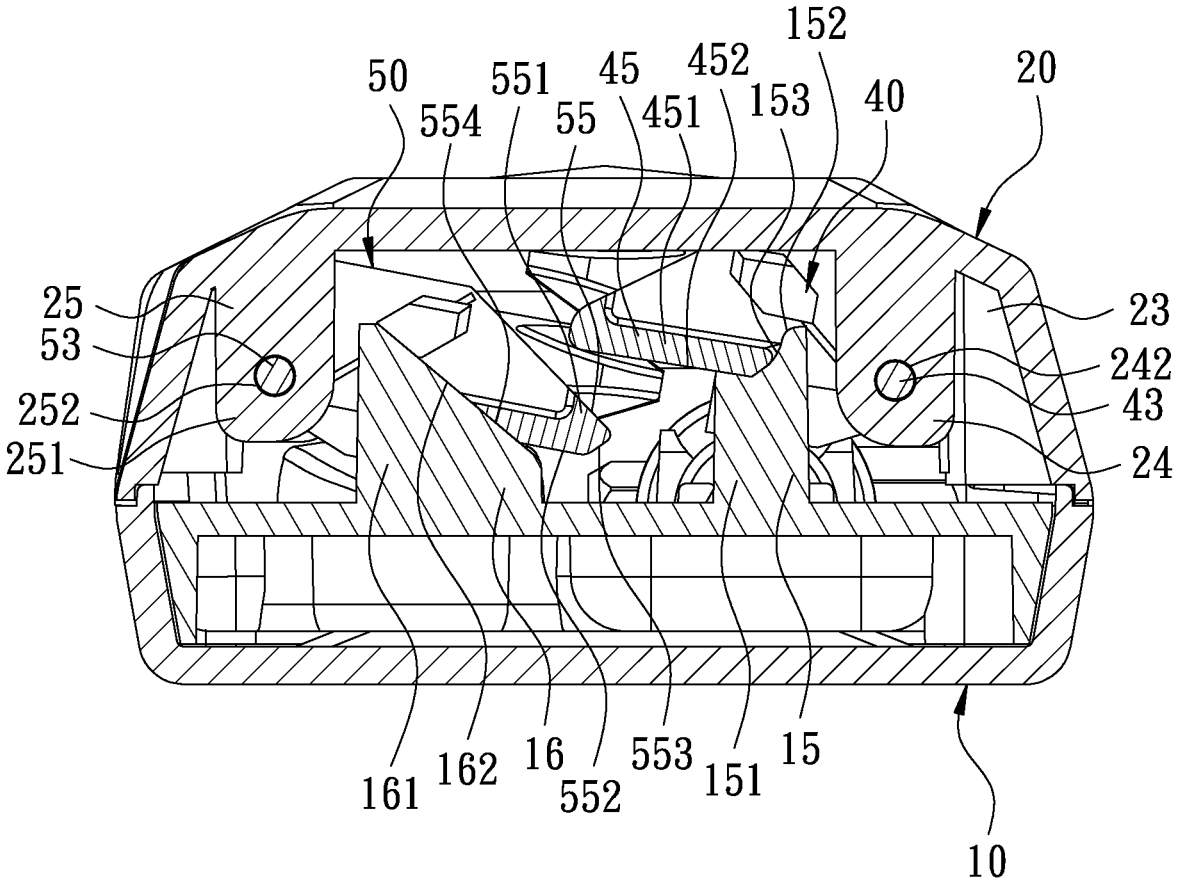
FIG. 6 is a cross-sectional view taken along line 6-6 of FIG. 5.
Figure 7:
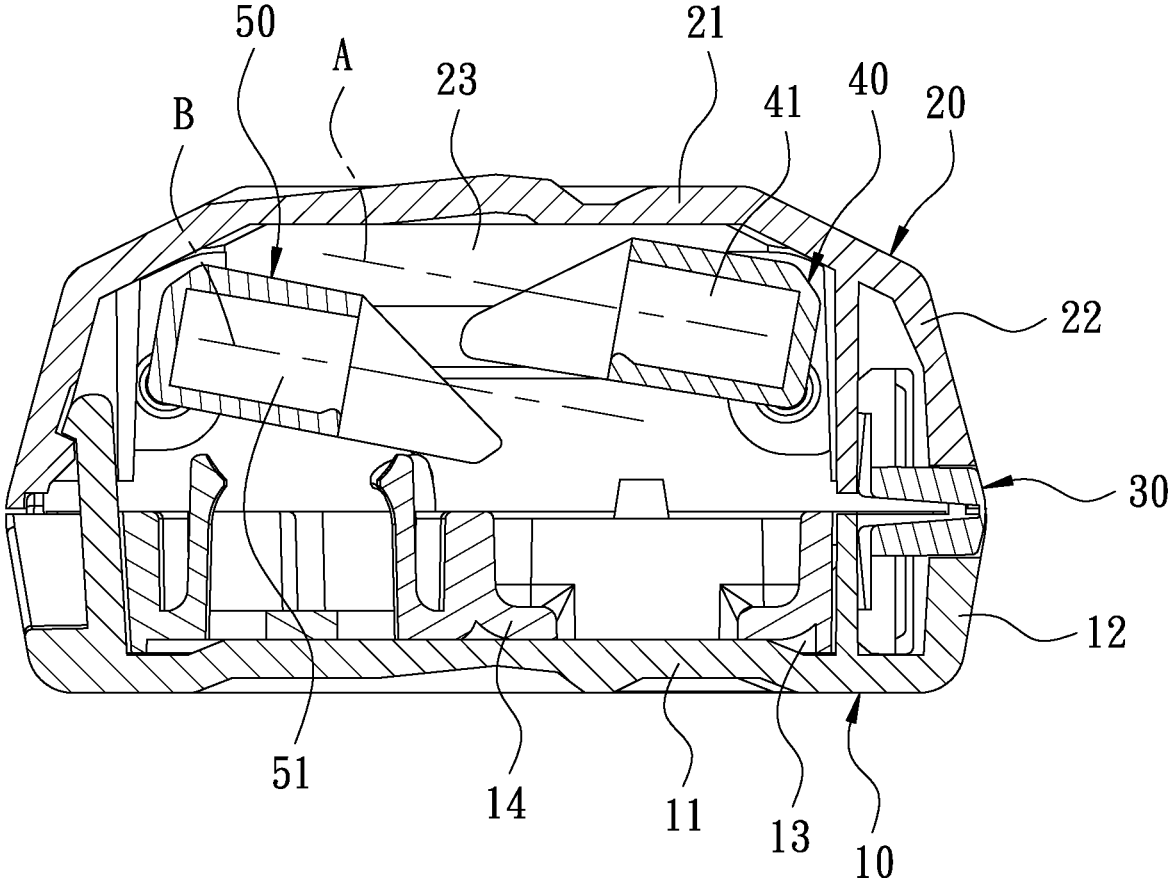
FIG. 7 is a cross-sectional view taken along line 7-7 of FIG. 5.

FIG. 6 is a cross-sectional view taken along line 6-6 of FIG. 5. FIG. 7 is a cross-sectional view taken along line 7-7 of FIG. 5. Please also refer to FIG. 4. The storage tray 14 has a first guiding portion 15 extending toward the exterior of the first opening 131. The first receiving seat 40 has a first abutting portion 45 corresponding to the first guiding portion 15. When the second housing 20 is in the closed position, the first abutting portion 45 is guided by the first guiding portion 15 to drive the first receiving seat 40 to be received in the second accommodating space 23. In this embodiment, the first guiding portion 15 has a first raised block 151. The first raised block 151 has a first guiding surface 152. The first guiding surface 152 is a curved surface. The first abutting portion 45 has a first abutting block 451. The first abutting block 451 has a first sliding surface 452 corresponding to the first guiding surface 152. The first raised block 151 has a confining groove 153 adjacent to the first guiding surface 152. As shown in FIG. 6, when the second housing 20 is in the closed position, the first abutting block 451 is confined in the confining groove 153. Similarly, the storage tray 14 has a second guiding portion 16 extending toward the exterior of the first opening 131. The second receiving seat 50 has a second abutting portion 55 corresponding to the second guiding portion 16. When the second housing 20 is in the closed position, the second abutting portion 55 is guided by the second guiding portion 16 to drive the second receiving seat 50 to be received in the second accommodating space 23. As shown in FIG. 7, particularly mentioned in closed state of the tool box, a central axis B of the second receiving grooves 51 and a central axis A of the first receiving grooves 41 are located on different planes. In this embodiment, the second guiding portion 16 has a second raised block 161. The second raised block 161 has a second guiding surface 162. The second guiding surface 162 is an inclined surface. The guiding direction of the second guiding surface 162 is different from the guiding direction of the first guiding surface 152. As shown in this embodiment, the inclination directions of the first guiding surface 152 and the second guiding surface 162 are opposite. The second abutting portion 55 has a second abutting block 551. The second abutting block 551 has a second sliding surface 552 corresponding to the second guiding surface 152. The second abutting portion 55 further has a swing flange 553 adjacent to one side of the second sliding surface 552 and a confining surface 554 adjacent to the other side of the second sliding surface 552. The confining surface 554 and the second sliding surface 552 are not parallel to each other.

Figure 8:
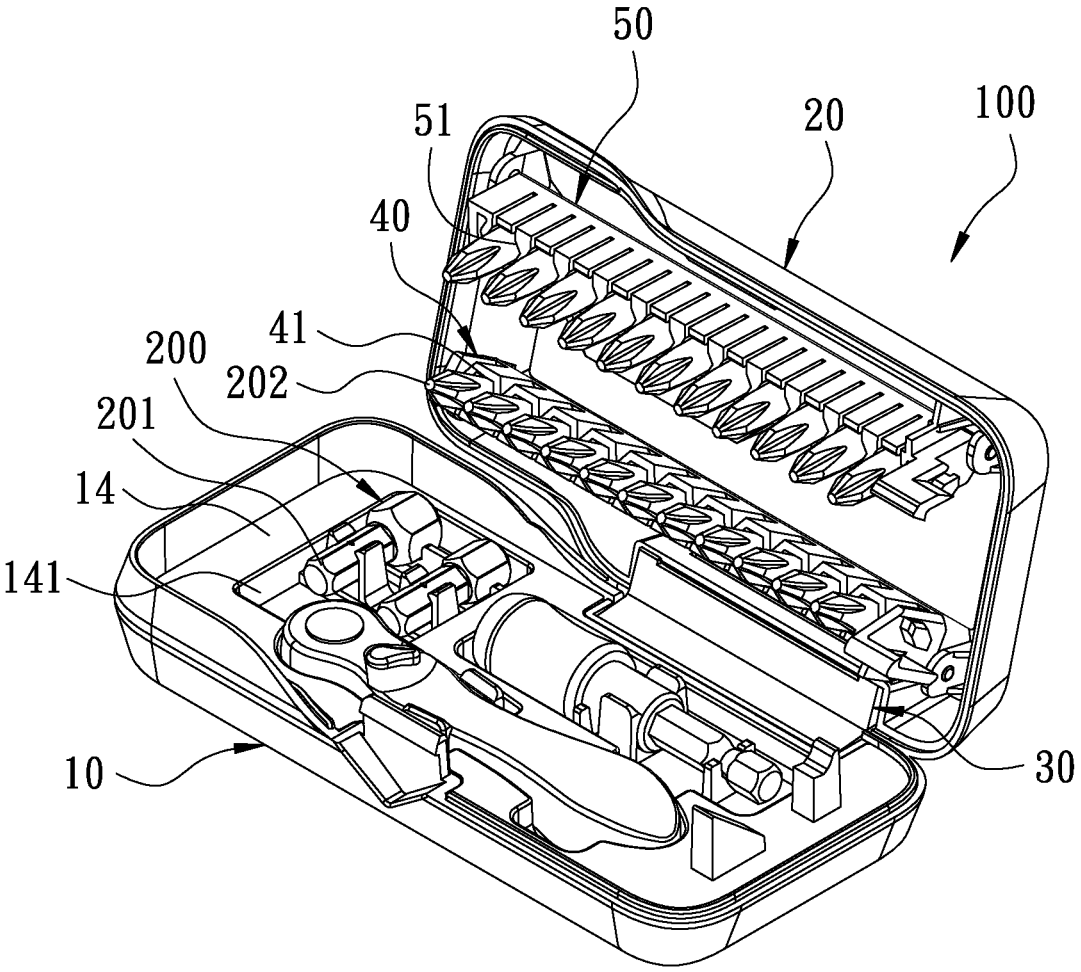
FIG. 8 is a schematic view of the preferred embodiment of the present invention when in use.

FIG. 8 is a schematic view of the preferred embodiment of the present invention when in use. The tool box 100 in this embodiment is mainly used for storing a tool bit set 200. When in use, a plurality of tools 201 of the tool bit set 200, such as extension rods and handles, are placed in the accommodating grooves 141 of the storage tray 14. The accommodating grooves 141 may correspond in shape to the tools 201 as shown in the figures, so as to obtain a better positioning effect. In addition, a plurality of bits 202 of the tool bit set 200 are received in the first receiving grooves 41 of the first receiving seat 41 and the second receiving grooves 51 of the second receiving seat 50, respectively. Thus, the tool bit set 200 is stored in the tool box 100.

Figure 9:
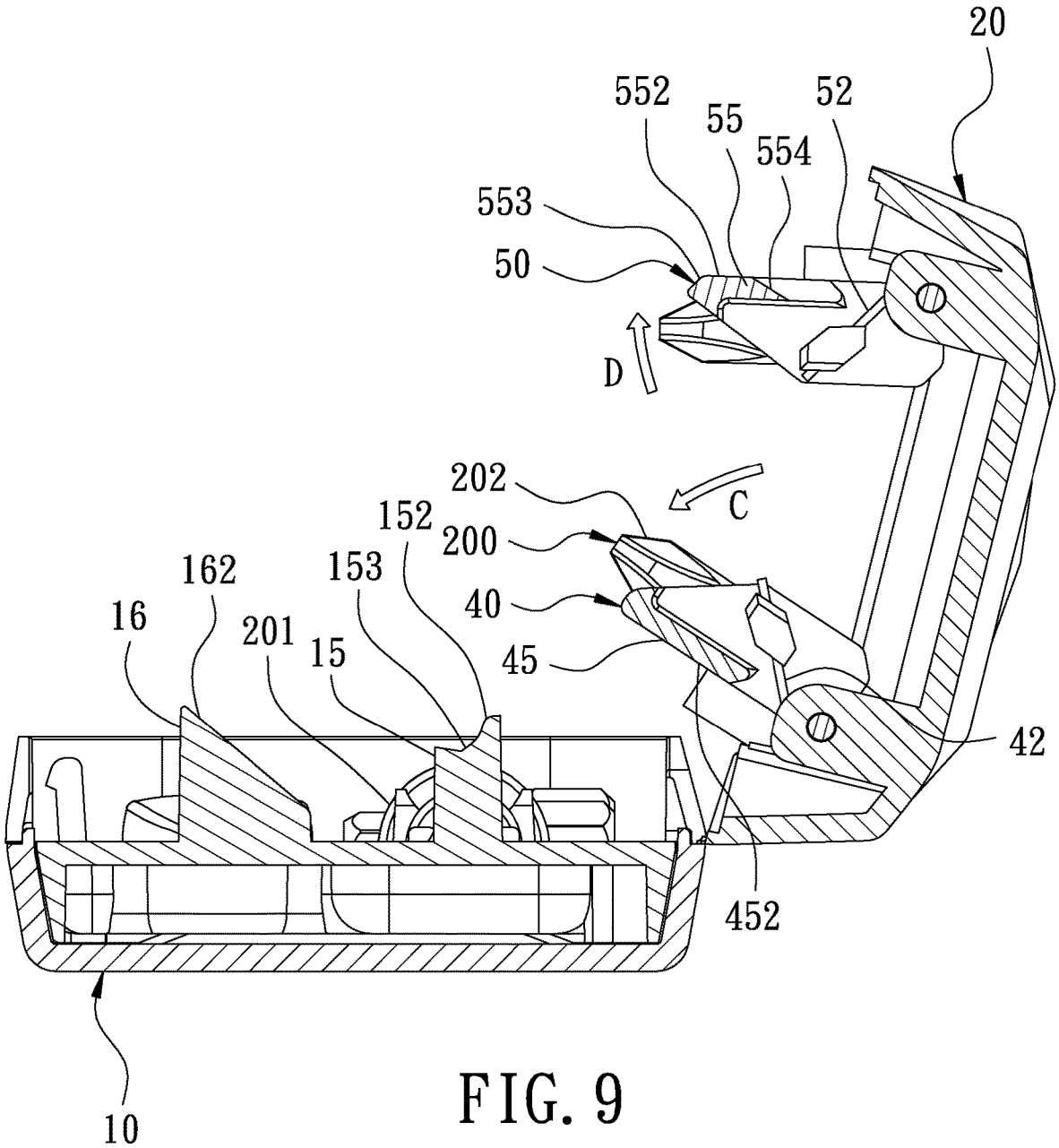
FIG. 9 is a schematic view of the preferred embodiment of the present invention in an open state when in use.
Figure 10:
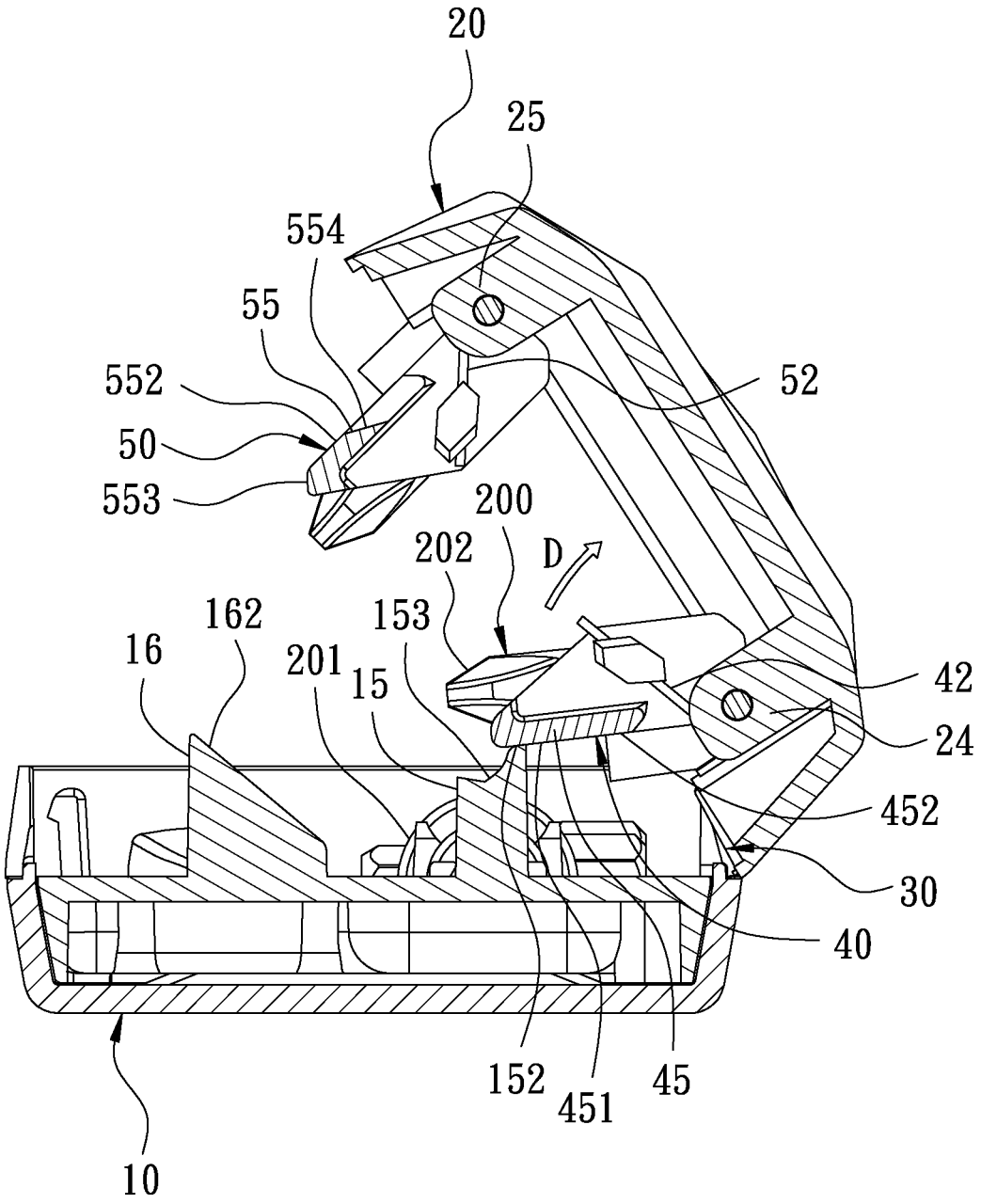
FIG. 10 is a first schematic view of the preferred embodiment of the present invention when the second housing is to be closed.
Figure 11:
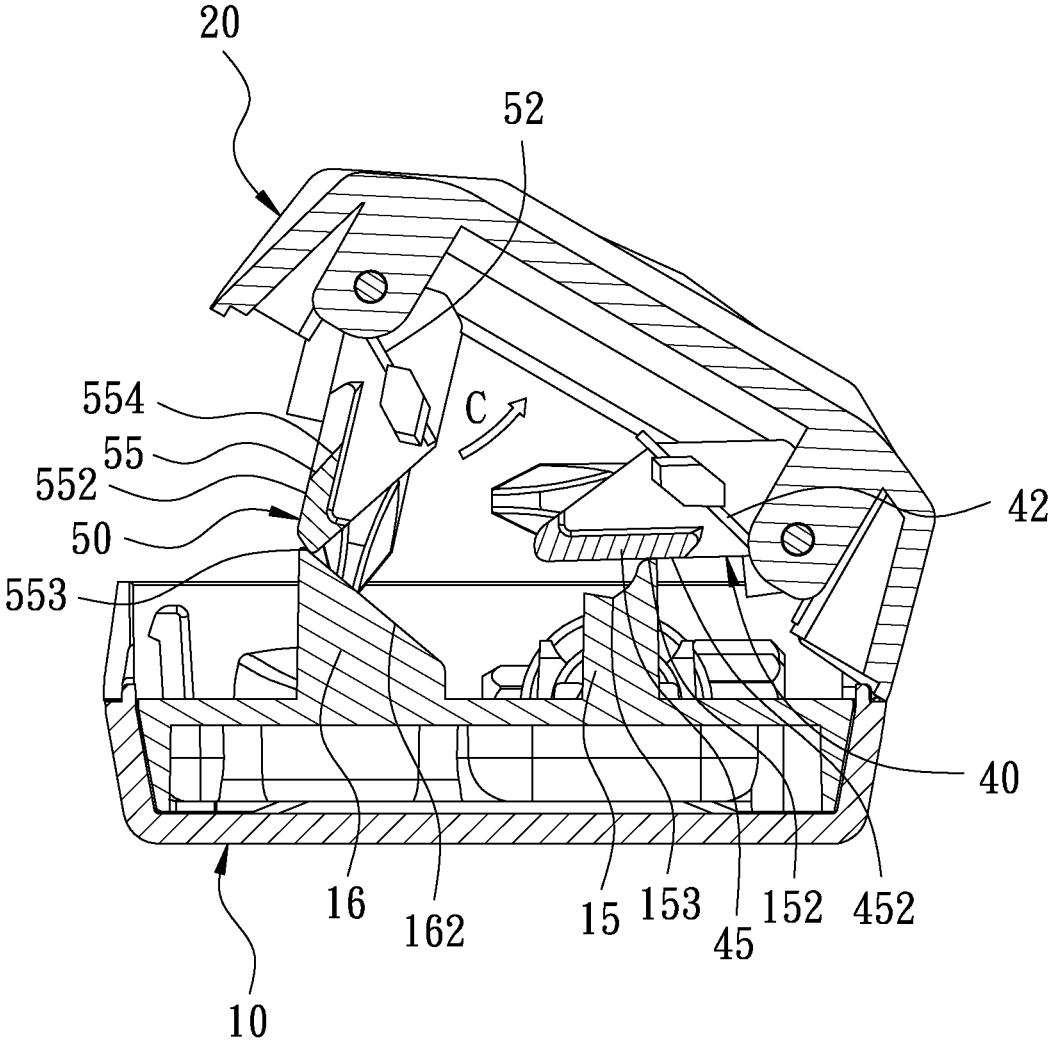
FIG. 11 is a second schematic view of the preferred embodiment of the present invention when the second housing is to be closed.
Figure 12:
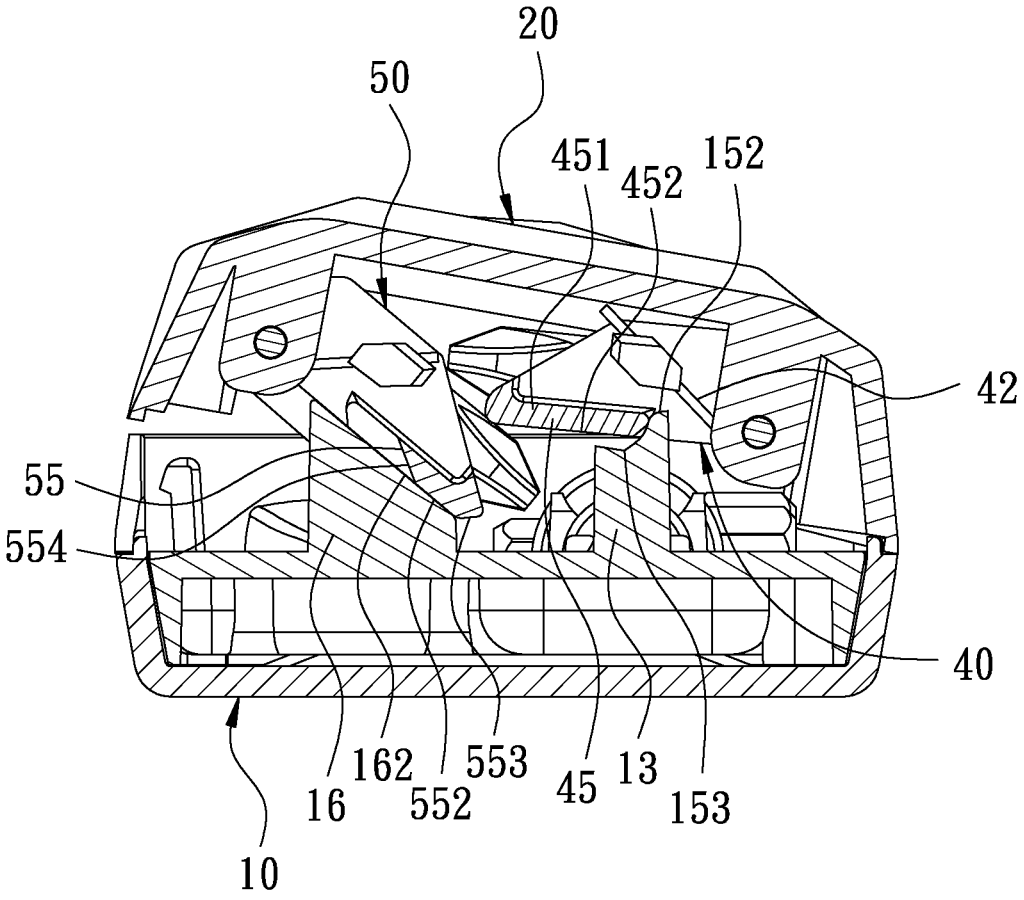
FIG. 12 is a third schematic view of the preferred embodiment of the present invention when the second housing is to be closed.
Figure 13:
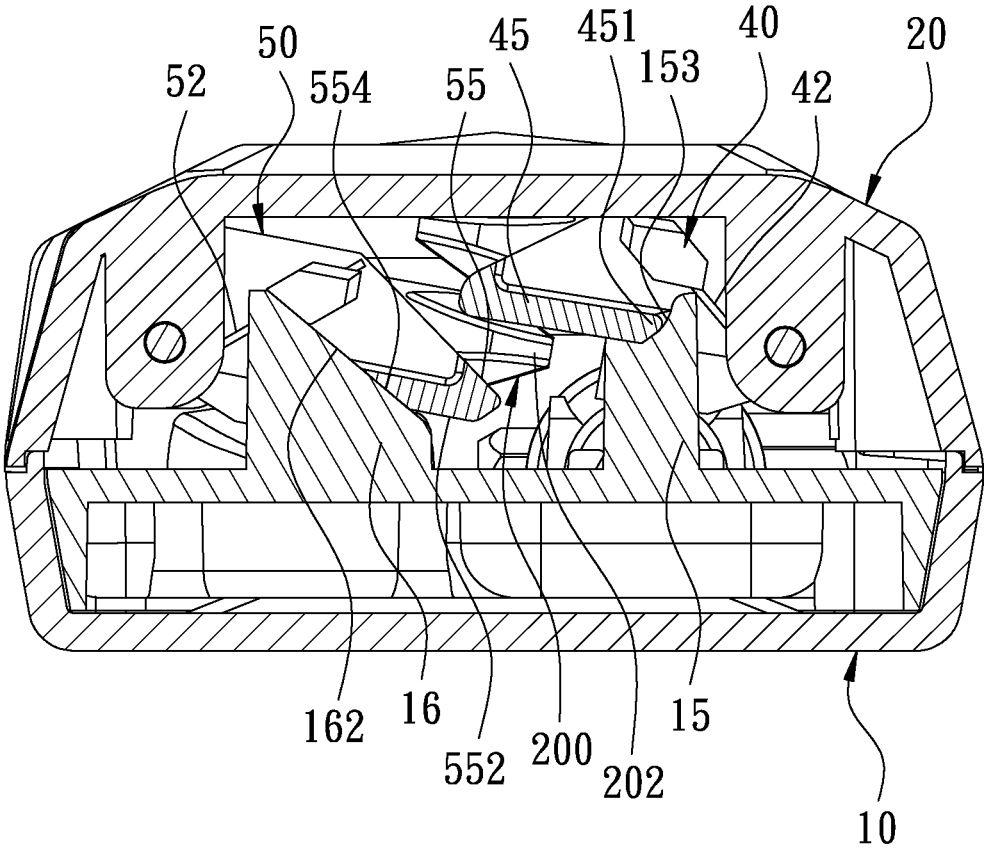
FIG. 13 is a first schematic view of the preferred embodiment of the present invention in a closed state.

FIG. 9 is a schematic view of the preferred embodiment of the present invention in an open state when in use. When the user opens the second housing 20 for the second housing 20 to be in the open position, the first elastic member 42 pushes the first receiving seat 40 to rotate in a first direction C and makes the first receiving seat 40 extend out of the second opening 231 therefore making the first receiving grooves 41 face the exterior of the second opening 231. At the same time, the second elastic member 52 pushes the second receiving seat 50 to rotate in a second direction D opposite to the first direction C and makes the second receiving seat 50 extends out of the second opening 231 therefore making the second receiving grooves 51 face the exterior of the second opening 231. Thus, by means of the rotations in opposite directions, the distance between the first receiving seat 40 and the second receiving seat 50 can be increased for the user to take the bits 202 easily. On the other hand, there is no direct connection relationship between the first guide portion 15 and the first abutting portion 45, and there is no direct connection relationship between the second guiding portion 16 and the second abutting portion 55. Thus, when the user opens the tool box 100 to make the second housing 20 move toward the open position, the opening angle of the second housing 20 is not limited. In the event of dropping or impacting by an external force, the tool box 100 won't be damaged easily.

FIGS. 10-13 are schematic views of the preferred embodiment of the present invention when the second housing is to be closed. When the tool box 100 is to be closed, the second housing 20 moves down toward the first housing 10. At this time, owing to the distance from the second connecting portion 25 to the hinge member 30 greater than the distance from the first connecting portion 24 to the hinge member 30, when the second housing 20 is moved from the open position to the closed position, the first sliding surface 452 of the first abutting portion 45 first contacts the first guiding surface 152 of the first guiding portion 15 and is guided by the first guiding surface 152 to drive the first receiving seat 40 to rotate in the second direction D until the first abutting block 451 is disengaged from the first guiding surface 152 and accommodated in the confining groove 153. At this time, the first receiving seat 40 is turned to enter the second opening 231 and is received in the second accommodating space 23. When the first sliding surface 452 is about to depart from the guiding state of the first guiding surface 152, the second abutting portion 55 is in contact with the second guiding portion 16 and guided by the second guiding surface 162 to swing. As shown in FIGS. 10-13, the second guiding surface 162 abuts against the swing flange 553, the second sliding surface 552 and the confining surface 554 in sequence, so that the second receiving seat 50 is pivoted in the first direction C. Thus, the second receiving seat 50 is turned to enter the second opening 231 and received in the second accommodating space 23. It is worth mentioning that through the above-mentioned design of driving the first receiving seat 40 and the second receiving seat 50 successively, interference between the first receiving seat 40 and the second receiving seat 50 is avoidable when they are rotated.

Figure 14:
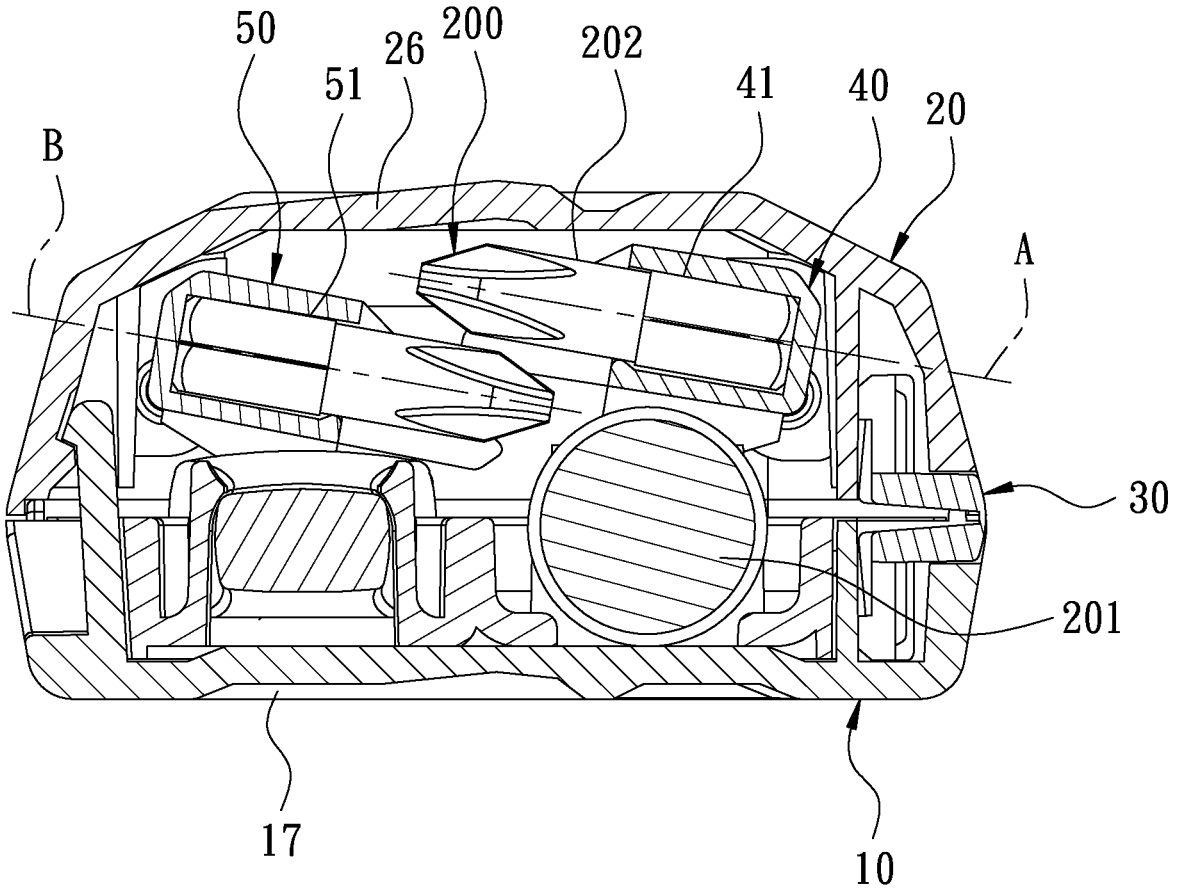
FIG. 14 is a second schematic view of the preferred embodiment of the present invention in a closed state.

FIG. 14 is a schematic view of the preferred embodiment of the present invention in a closed state. When the second housing 20 is in the closed position, the central axis B of the second receiving grooves 51 and the central axis A of the first receiving grooves 41 are located on different planes. Thereby, the bits 202 received in the first receiving seat 40 and the bits 202 received in the second receiving seat 50 are partially overlapped, so that the area of the second accommodating space 23 occupied by the first receiving seat 40 and the second receiving seat 50 can be reduced. The tool box 100 is relatively compact as a whole, which achieves the purpose of miniaturizing the tool box 100 for the user to take it along. Preferably, referring to FIG. 7, when the second housing 20 is in the closed position, the angle between the plane located on the central axis A of the first receiving grooves 41 and the first bottom wall 11 of the first housing 10 is not greater than 30 degrees, and the angle between the plane located on the central axis B of the second receiving grooves 51 and the first bottom wall 11 of the first housing 10 is not greater than 30 degrees.

Figure 15:
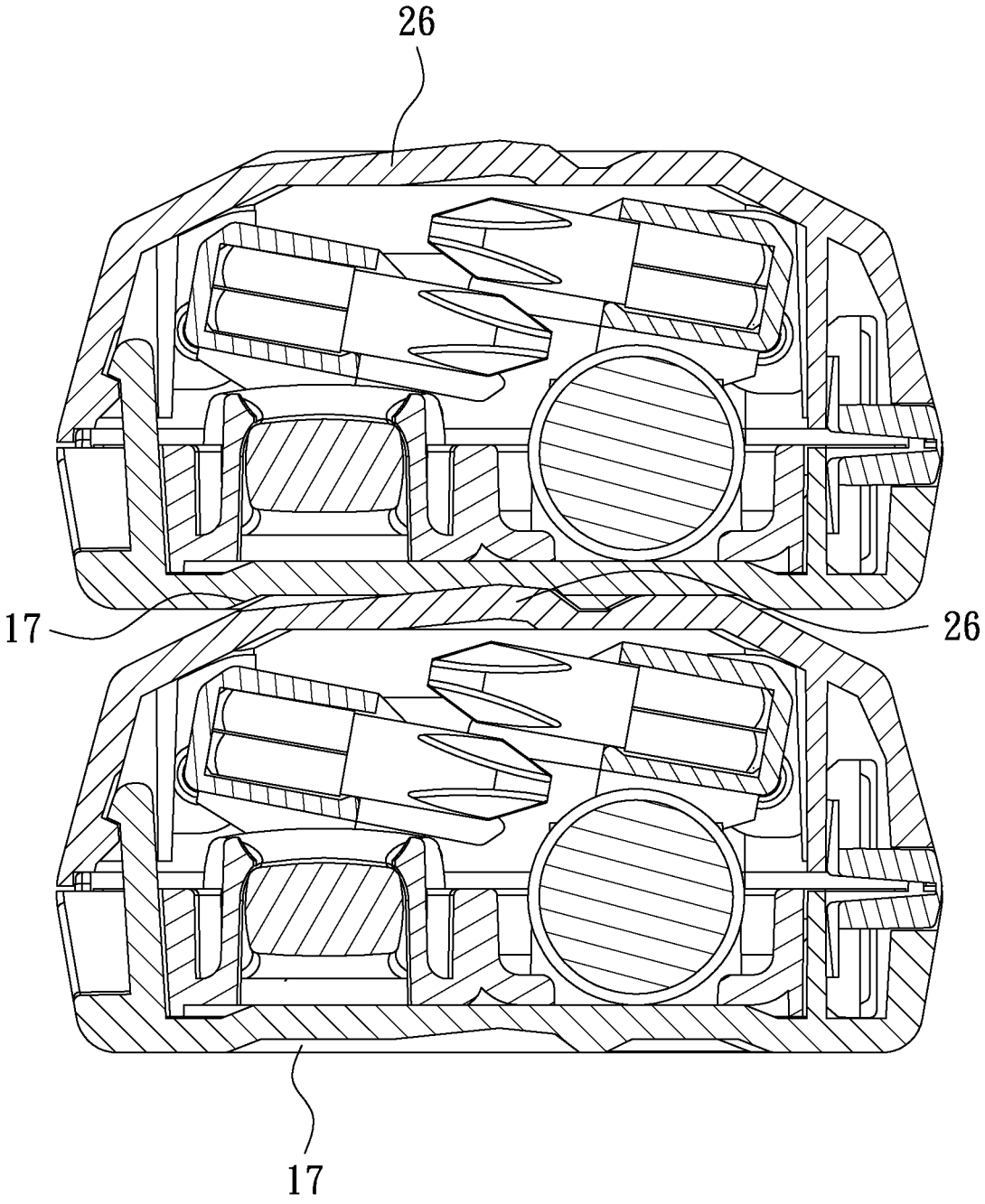
FIG. 15 is a schematic view of the preferred embodiment of the present invention in a stacking state.

FIG. 15 is a schematic view of the preferred embodiment of the present invention in a stacking state. A positioning groove 17 is recessed into an outer surface of the first bottom wall 11. The second housing 20 is provided with a positioning block 26 protruding from the outer surface of the second bottom wall 21 and corresponding to the positioning groove 17. Thereby, two tool boxes 100 is stackable through the positioning block 26 of the tool box to be positioned in the positioning groove 17 of the other tool box. Slippage is not easy to occur.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A tool box, comprising:

a first housing, having a first bottom wall, a first circumferential wall connected to the first bottom wall, and a first accommodating space defined between the first bottom wall and the first circumferential wall, the first accommodating space having a first opening, the first housing further having a first guide portion and a second guide portion extending outwardly toward the first opening;

a second housing, connected to the first housing, the second housing having a second bottom wall, a second circumferential wall connected to the second bottom wall, and a second accommodating space defined between the second bottom wall and the second circumferential wall, the second accommodating space having a second opening, at least one portion of the second circumferential wall being connected to the first circumferential wall through a hinge member so that the second housing is rotatable relative to the first housing with the hinge member as its axis of rotation to be in a closed position or an open position, wherein when in the open position, the second housing is moved away from the first housing, wherein when in the closed position, the second housing covers the first housing, wherein the second housing includes a first connecting portion and a second connecting portion in the second accommodating space;

a first receiving seat, accommodated in the second accommodating space and rotatably connected to the first connecting portion, the first receiving seat being provided with a plurality of spaced first receiving grooves, at least one first elastic member being connected to the first receiving seat, wherein when the second housing is moved toward the open position, the first elastic member pushes the first receiving seat to rotate in a first direction and extend out of the second opening therefore making the first receiving grooves face toward the exterior of the second opening, wherein the first receiving seat has a first abutting portion corresponding to the first guide portion, wherein when the second housing is moved toward the closed position, the first abutting portion is guided by the first guide portion to drive the first receiving seat to rotate in a second direction opposite to the first direction and to be received in the second accommodating space;

a second receiving seat, accommodated in the second accommodating space, and rotatably connected to the second connecting portion, the second receiving seat being provided with a plurality of spaced second receiving grooves, at least one second elastic member being connected to the second receiving seat, wherein when the second housing is moved toward the open position, the second elastic member pushes the second receiving seat to rotate in the second direction and extend out of the second opening therefore making the second receiving grooves face the second opening, wherein the second receiving seat has a second abutting portion corresponding to the second guide portion, wherein when the second housing is moved toward the closed position, the second abutting portion is guided by the second guide portion to drive the second receiving seat to rotate in the first direction and to be received in the second accommodating space;

wherein when the second housing is moved from the open position to the closed position, the first abutting portion first contacts the first guide portion and is guided by the first guide portion to drive the first receiving seat to rotate in the second direction, and then the second abutting portion contacts the second guide portion and is guided by the second guide portion to drive the second receiving seat to rotate in the first direction, a central axis of the second receiving grooves and a central axis of the first receiving grooves are located on different planes, when a plurality of bits are respectively placed in the first receiving grooves and the second receiving grooves, the bits received in the first receiving grooves and the bits received in the second receiving grooves are partially overlapped.

2. The tool box as claimed in claim 1, wherein the first guide portion has a first block, the first block has a first guiding surface, the first abutting portion has a first abutting block, the first abutting block has a first sliding surface corresponding to the first guiding surface, when the second housing is moved from the open position to the closed position, the first sliding surface slides along the first guide surface; the second guiding portion has a second block, the second block has a second guiding surface, the second abutting portion has a second block, the second block has a second sliding surface corresponding to the second guiding surface, when the second housing is moved from the open position to the closed position, the second sliding surface slides along the second guiding surface; wherein a guiding direction of the second guiding surface is different from a guiding direction of the first guiding surface.

3. The tool box as claimed in claim 2, wherein the first block has a confining groove adjacent to the first guiding surface, when the second housing is in the closed position, the first abutting block is confined in the confining groove.

4. The tool box as claimed in claim 3, wherein the second abutting portion further has a swing flange adjacent to one side of the second sliding surface, when the second housing is moved from the open position to the closed position, the swing flange of the second abutting portion is pivoted due to abutment of the second guiding surface, therefore making the second receiving seat pivoted toward the first direction.

5. The tool box as claimed in claim 4, wherein the second abutting portion further has a confining surface adjacent to another side of the second slide surface, the confining surface and the second sliding surface are not parallel to each other, when the second housing is moved from the open position to the closed position, the second guiding surface abuts against the swing flange, the second sliding surface and the confining surface in sequence.

6. The tool box as claimed in claim 1, wherein the first connecting portion is in the form of a pair of first lugs, each of the first lugs has a first through hole, two sides of the first receiving seat have first rotating shafts corresponding to each of the first lugs respectively, each of the first rotating shafts is rotatably connected to each of the first through holes, so that the first receiving seat is rotatable relative to the second housing; the second connecting portion is in the form of a pair of second lugs, each of the second lugs has a second through hole, two sides of the second receiving seat have second rotating shafts corresponding to each of the second lugs respectively, each of the second rotating shafts is rotatably connected to each of the second through holes, so that the second receiving seat is rotatable relative to the second housing.

7. The tool box as claimed in claim 6, wherein the first receiving seat has a first positioning portion corresponding to at least one of the first rotating shafts, the first elastic member is a torsion spring fitted on the first rotating shaft, the first elastic member has two elastic arms abutting against the first positioning portion and an inner surface of the second bottom wall, respectively; the second receiving seat has a second positioning portion corresponding to at least one of the second rotating shafts, the second elastic member is a torsion spring fitted on the corresponding second rotating shaft, the second elastic member has two elastic arms abutting against the second positioning portion and the inner surface of the second bottom wall, respectively.

8. The tool box as claimed in claim 1, wherein a positioning groove is recessed into an outer surface of the first bottom wall, the second housing is provided with a positioning block protruding from an outer surface of the second bottom wall and corresponding to the positioning groove, and the tool box is stackable on top of the other tool box through the positioning block positioned in the positioning groove of the other tool box.

9. The tool box as claimed in claim 1, wherein when the second housing is in the closed position, an angle between the plane located at the central axis of the first receiving grooves and the first bottom wall of the first housing is not greater than 30 degrees, and an angle between the plane located at the central axis of the second receiving grooves and the first bottom wall of the first housing is not greater than 30 degrees.

* * * * *